US008458849B2

(12) United States Patent
Chiu

(10) Patent No.: US 8,458,849 B2
(45) Date of Patent: Jun. 11, 2013

(54) MOBILE ROBOTIC VACUUM CLEANER WITH A DETACHABLE ELECTRICAL FAN

(75) Inventor: Ting-Yin Chiu, Taichung (TW)

(73) Assignee: Egenpower Inc., Laguna Niguel, CA (US)

( * ) Notice: Subject to any disclaimer, the term of this patent is extended or adjusted under 35 U.S.C. 154(b) by 443 days.

(21) Appl. No.: 12/954,166

(22) Filed: Nov. 24, 2010

(65) Prior Publication Data

US 2012/0084935 A1 Apr. 12, 2012

(30) Foreign Application Priority Data

Oct. 11, 2010 (CN) ..... 2010 2 0575526 U

(51) Int. Cl.
*A47L 5/00* (2006.01)

(52) U.S. Cl.
USPC ..... 15/319; 15/327.2

(58) Field of Classification Search
USPC ..... 15/319, 327.1, 327.2, 327.6, 327.7, 15/330; 900/40
See application file for complete search history.

(56) References Cited

U.S. PATENT DOCUMENTS

| | | | | |
|---|---|---|---|---|
| 2005/0015914 | A1* | 1/2005 | You et al. | 15/319 |
| 2008/0155768 | A1* | 7/2008 | Ziegler et al. | 15/4 |
| 2008/0276408 | A1* | 11/2008 | Gilbert et al. | 15/320 |
| 2008/0281470 | A1* | 11/2008 | Gilbert et al. | 700/259 |
| 2010/0037418 | A1* | 2/2010 | Hussey et al. | 15/319 |
| 2011/0004339 | A1* | 1/2011 | Ozick et al. | 700/245 |
| 2011/0191976 | A1* | 8/2011 | Yan | 15/319 |

* cited by examiner

*Primary Examiner* — Dung Van Nguyen
(74) *Attorney, Agent, or Firm* — Muncy, Geissler, Olds & Lowe, PLLC

(57) ABSTRACT

A mobile robotic vacuum cleaner with a detachable electrical fan is disclosed to include a housing having a fan chamber, an electrical fan detachably mounted in the fan chamber, and a cover plate detachably fastened to the housing to hold down the electrical fan in the fan chamber. Subject to the use of the detachable cover plate to hold down the electrical fan in the fan chamber, the electrical fan can be installed in the fan chamber conveniently without any fastening members, such as screws, or the use of any hand tool, such as screwdriver and, after removal of the cover plate, the electrical fan can be removed from the housing easily.

10 Claims, 6 Drawing Sheets

MOBILE ROBOTIC VACUUM CLEANER WITH A DETACHABLE ELECTRICAL FAN

BACKGROUND OF THE INVENTION

1. Field of the Invention

The present invention relates to mobile robotic vacuum cleaner technology and more specifically, to a mobile robotic vacuum cleaner with a detachable electrical fan that facilitates mounting and dismounting of the electrical fan during maintenance.

2. Description of the Related Art

A mobile robotic vacuum cleaner is able to navigate a living space safely around unforeseen obstacles while vacuuming the floor. For the advantage of automatic vacuuming without assistant of any person around, mobile robotic vacuum cleaner is highly invited by people although it is expensive. To achieve vacuuming, a mobile robotic vacuum cleaner has an electrical fan for suction dust from the floor. The power and lifespan of the electrical fan of a mobile robotic vacuum cleaner will determine the vacuuming performance and lifespan of the mobile robotic vacuum cleaner.

Conventionally, the electrical fan of a mobile robotic vacuum cleaner is fixed to the inside of the fan chamber in the housing of the mobile robotic vacuum cleaner with tie screws. Thus, when the electrical fan fails and a repair work or replacement is necessary, it is necessary to dismount the parts of the housing of the mobile robotic vacuum cleaner to let the fan chamber be exposed to the outside and then to remove the tie screws with a screwdriver for allowing removal of the electrical fan from the fan chamber for a repair work or replacement. When mounting the electrical fan in the housing of the mobile robotic vacuum cleaner again, it is necessary to repeat the aforesaid steps reversely. In other words, it is inconvenient to mount and dismount an electrical fan of a conventional mobile robotic vacuum cleaner.

SUMMARY OF THE INVENTION

The present invention has been accomplished under the circumstances in view. It is the main object of the present invention to provide a mobile robotic vacuum cleaner with a detachable electrical fan, which allows mounting of the electrical fan easily without any screws or other fastening means.

It is another object of the present invention to provide a mobile robotic vacuum cleaner with a detachable electrical fan, which allows dismounting of the electrical fan easily, facilitating maintenance or replacement of the electrical fan.

To achieve these and other objects of the present invention, a mobile robotic vacuum cleaner with a detachable electrical fan comprises a housing, an electrical fan and a cover plate. The housing defines a fan chamber and an exhaust port in communication with the fan chamber. The electrical fan is detachably mounted in the fan chamber of the housing, comprising a suction hole, and an air discharge outlet facing the exhaust port of the housing. The cover plate is detachably mounted in the housing and stopped against the electrical fan to hold the electrical fan in the fan chamber. The cover plate has an opening facing the suction hole. Subject to the use of the detachable cover plate to hold down the electrical fan in the fan chamber, the electrical fan can be installed in the fan chamber conveniently without any fastening members, such as screws, or the use of any hand tool, such as screwdriver. Further, after removal of the cover plate, the electrical fan can be removed from the housing easily.

Further, the cover plate comprises two retaining holes. Further, the housing comprises two retaining members. Each retaining member comprises a hook insertable into one the retaining hole to hook on the cover plate. By means of biasing the retaining members, the hooks of the retaining members can be moved into and out of the retaining holes to hook on the cover plate. When biasing the retaining members to disengage the hooks from the cover plate, the cover plate can be detached from the housing easily.

Further, the two retaining members are disposed in said fan chamber.

The mobile robotic vacuum cleaner further comprises at least one elastic means adapted for imparting a pressure to the electrical fan against the cover plate. Further, the elastic means can be a compression spring set in between the housing and the electrical fan. Preferably, four compression springs are between the housing and the electrical fan to provide a pressure to the electrical fan against the cover plate evenly.

Further, each compression spring has one end thereof sleeved onto a locating post in the fan chamber and an opposite end thereof positioned in one respective locating hole at the electrical fan.

The mobile robotic vacuum cleaner further comprises a gasket ring set in between the cover plate and the electrical fan and extending around the opening of the cover plate.

The mobile robotic vacuum cleaner as claimed in claim 7, further comprising an elastic means adapted for imparting a pressure to said electrical fan against said cover plate.

Other advantages and features of the present invention will be fully understood by reference to the following specification in conjunction with the accompanying drawings, in which like reference signs denote like elements of structure.

DETAILED DESCRIPTION OF THE INVENTION

Figure 1:
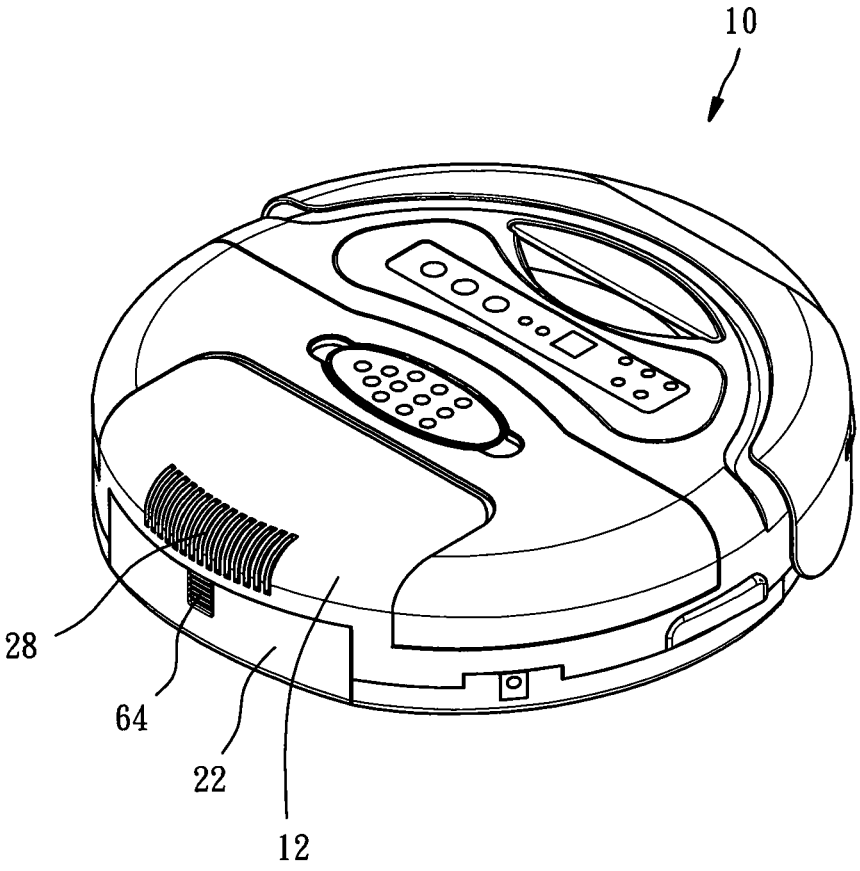
FIG. 1 is an elevational view of mobile robotic vacuum cleaner in accordance with the present invention.
Figure 2:
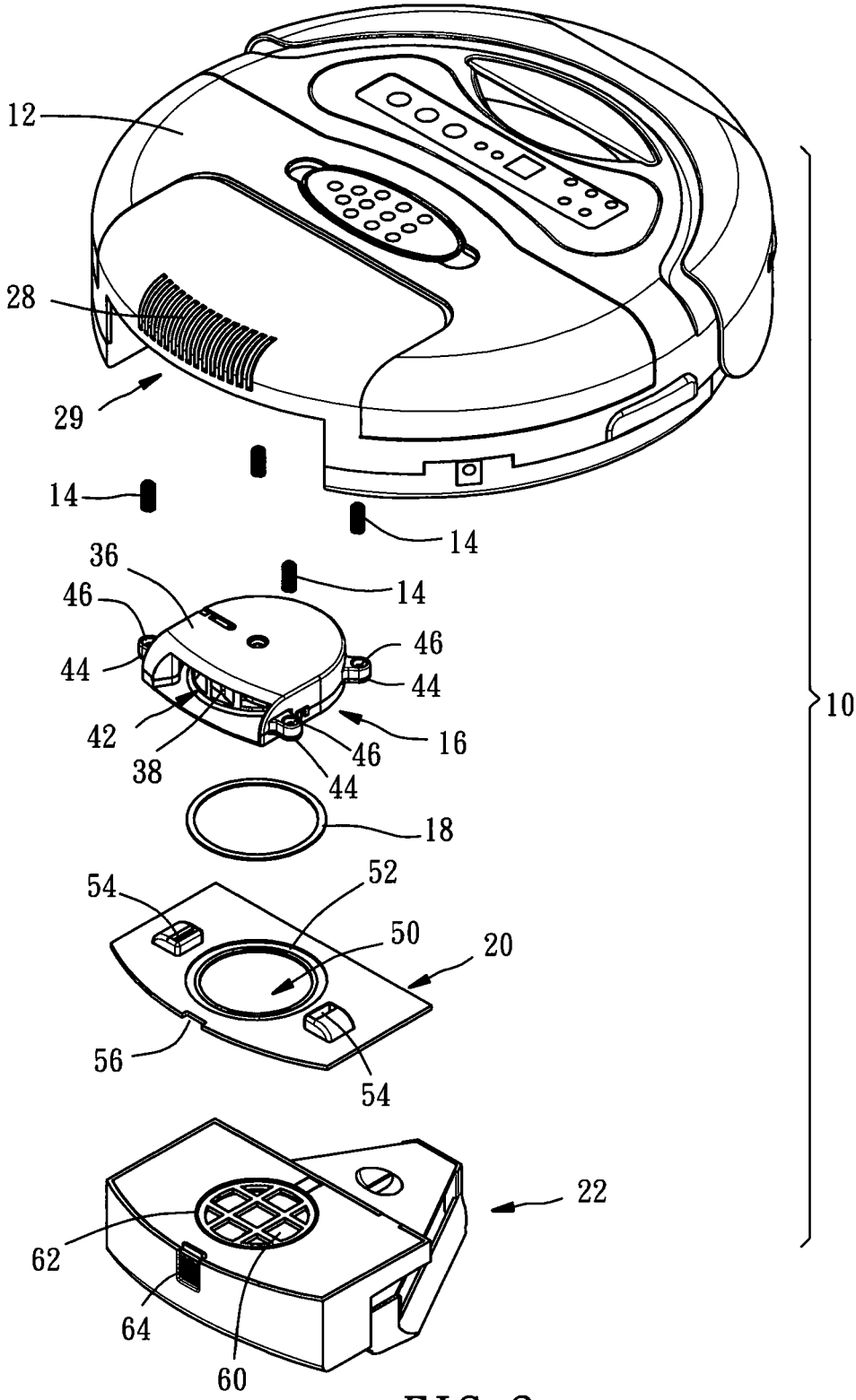
FIG. 2 is an exploded view of the mobile robotic vacuum cleaner in accordance with the present invention.
Figure 3:
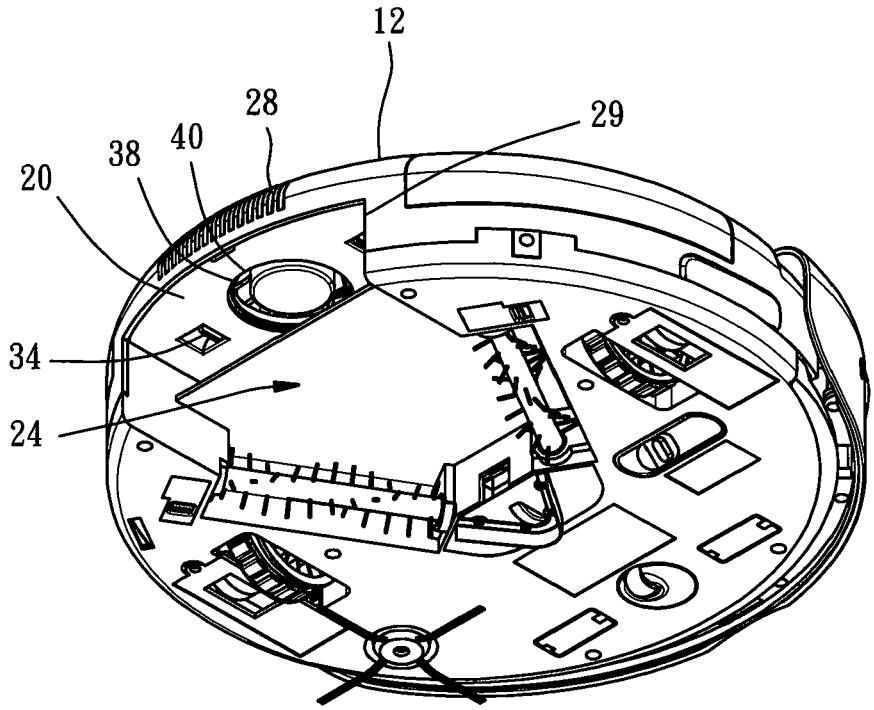
FIG. 3 is an oblique bottom view of the mobile robotic vacuum cleaner in accordance with the present invention after removal of the dust collector.
Figure 4:
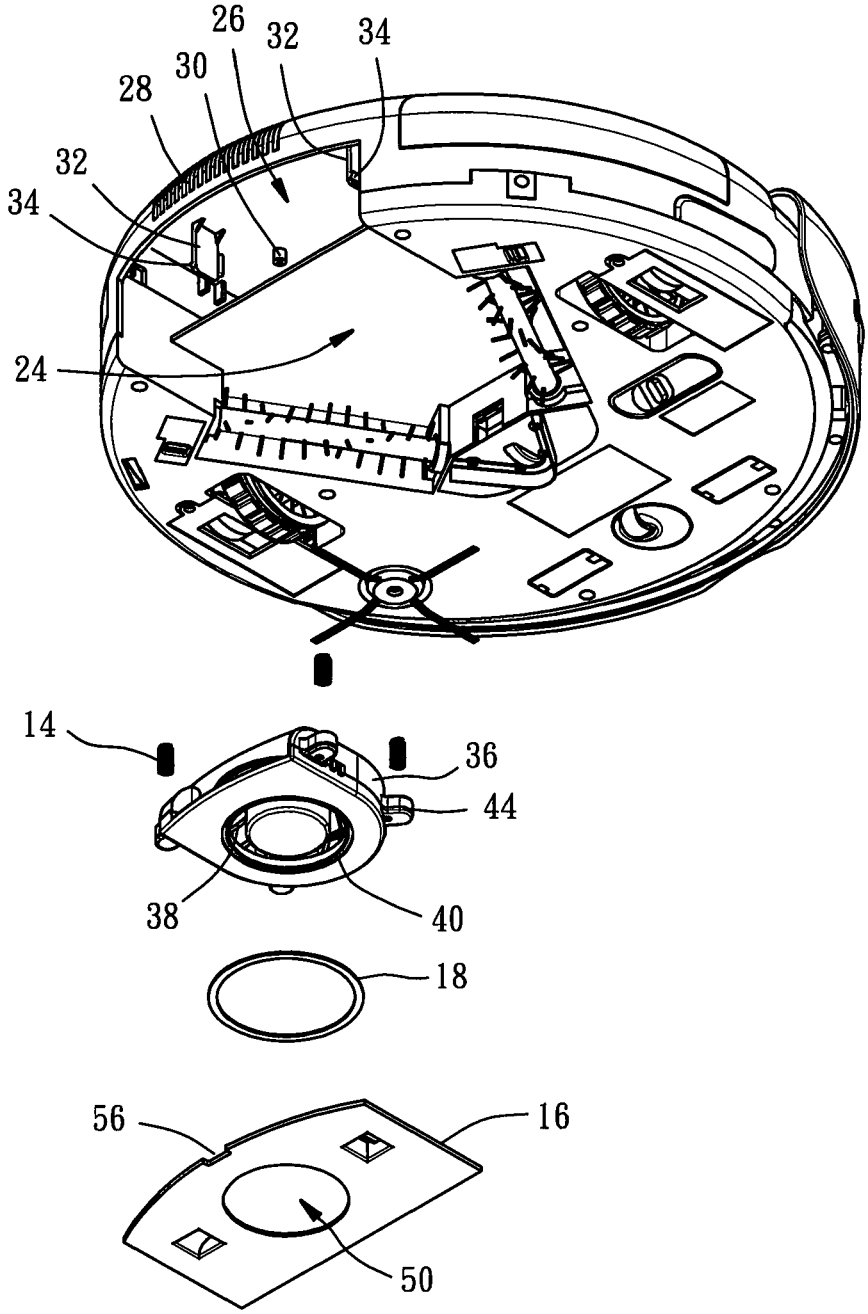
FIG. 4 is an exploded view of the mobile robotic vacuum cleaner in accordance with the present invention when viewed from the bottom side after removal of the dust collector.
Figure 5:
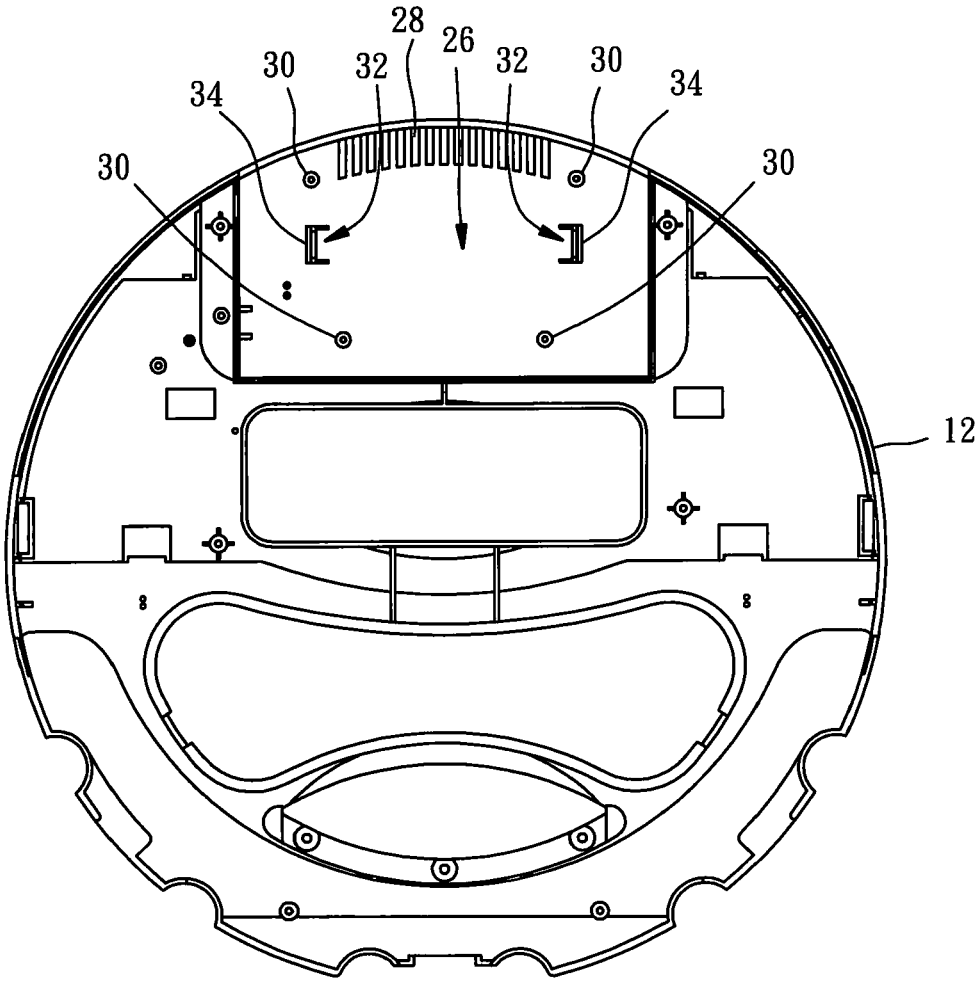
FIG. 5 is a bottom view of the mobile robotic vacuum cleaner in accordance with the present invention.
Figure 6:
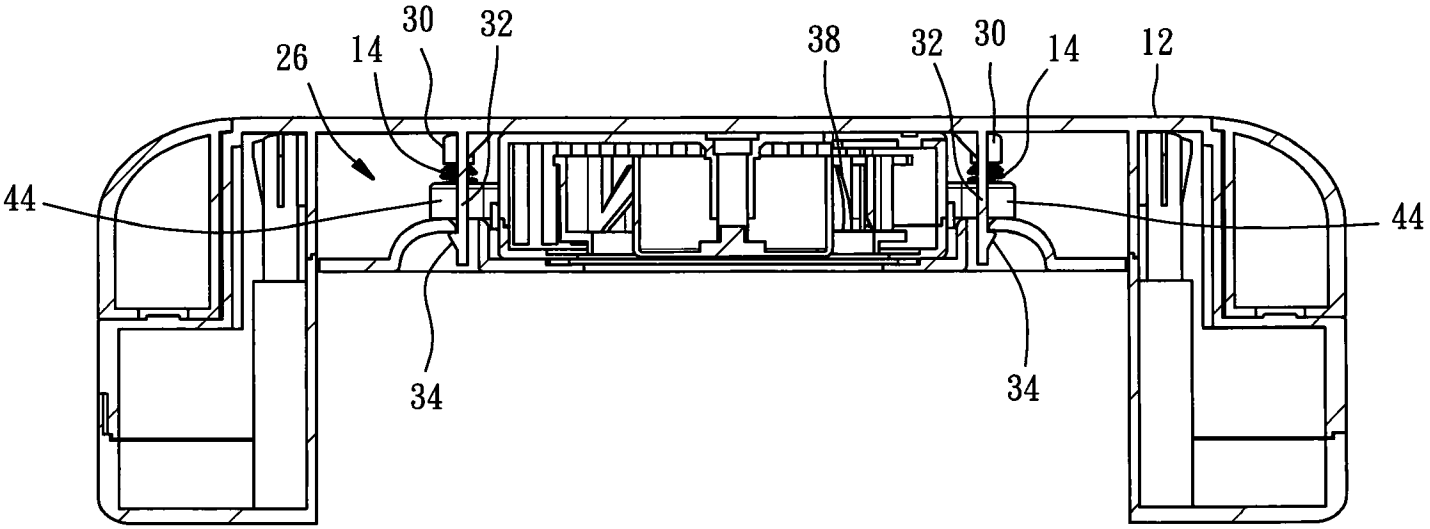
FIG. 6 is a sectional view of the present invention, illustrating the relative positioning among the housing, the electrical fan and the cover plate.

Referring to the annexed drawings in detail, a mobile robotic vacuum cleaner 10 in accordance with the present invention is shown comprising a housing 12, four elastic members 14, an electrical fan 16, a gasket ring 18, a cover plate 20 and a mobile dust collector 22.

The housing 12 comprises a dust collector chamber 24 and a fan chamber 26 disposed in the bottom side thereof in communication with each other, a grille type exhaust port 28 located on the top side thereof in communication with the fan chamber 26, a side opening 29 disposed in communication with the dust collector chamber 24, four cylindrical bottom mounting posts 30 spaced in the fan chamber 26 and two flat retaining members 32 spaced in the fan chamber 26. Each flat retaining member 32 comprises a hook 34. The housing 12 is molded from a plastic material so that the flat retaining members 32 will be forced to deform elastically when receiving a lateral force.

The elastic members 14 are, for example, compression springs. During installation, each elastic member 14 has its one end sleeved onto one end of one cylindrical bottom mounting post 30. After installation, the elastic members 14 are accommodated inside the fan chamber 26.

The electrical fan 16 according to the present preferred embodiment is a centrifugal fan comprising a fan housing 36 and a fan blade 38 mounted inside the fan housing 36. The fan housing 36 has a suction hole 40 on the bottom side thereof, an air discharge outlet 42 located on one lateral side thereof, and four lugs 44 spaced the periphery thereof. Each lug 44 has a recessed locating hole 46 on the top side thereof During installation, the electrical fan 16 is accommodated in the fan housing 36 to keep the suction hole 40 in the downward direction and to let the other end of each elastic member 14 be positioned in the recessed locating hole 46 on one respective lug 44. Thus, the elastic members 14 impart an upward thrust force to the electrical fan 16 toward the outside of the fan chamber 26.

The gasket ring 18 is an elastically deformable ring made of rubber, silicon rubber or the like, having a size slightly greater than the size of the suction hole 40 of the fan housing 36. During installation, the gasket ring 18 is attached to the bottom side of the fan housing 36 and arranged around the border of the suction hole 40.

The cover plate 20 comprises a center opening 50 fitting the suction hole 40 in dimension, a locating groove 52 located on the top wall thereof and extending around the center opening 50 for the positioning of the gasket ring 18, two retaining holes 54 disposed at two opposite sides relative to the center opening 50 and a retaining notch 56 located on the peripheral edge thereof at one side. During installation, the cover plate 20 is pressed on the electrical fan 16 to keep the center opening 50 in alignment with the suction hole 40 and to let the hooks 34 of the flat retaining members 32 be forced into the two retaining holes 54 into engagement with the cover plate 20. Thus, the cover plate 20 is detachably fastened to the housing 12. At this time, the gasket ring 18 is partially set in the locating groove 52, i.e., the gasket ring 18 is squeezed in between the electrical fan 16 and the cover plate 20 and extending around the center opening 50 and the suction hole 40. At the same tine, the elastic members 14 are compressed, and therefore the spring power of the elastic members 14 force the electrical fan 16 to stop against the cover plate 20 firmly. Thus, the electrical fan 16 is firmly secured to the inside of the fan chamber 26 without the use of any screws or other fastening members.

The mobile dust collector 22 comprises a dust collection chamber (not shown) located on the inside, a dust inlet (not shown) located on the bottom wall thereof in communication with the dust collection chamber, an air discharge outlet 62 located on the top wall thereof in communication with the dust collection chamber, a wire gauze filter 60 mounted in the air discharge outlet, and a retaining knob 64 located on one side thereof and biasable to engage the retaining notch 56 of the cover plate 20. The structural design of the mobile dust collector 22 is not within the scope of the claims of the present invention, no further detailed description in this regard is necessary. During installation, insert the mobile dust collector 22 through the side opening 29 into the dust collector chamber 24 to force the retaining knob 64 into engagement with the retaining notch 56 of the cover plate 20, and thus the mobile dust collector 22 is secured to the inside of the housing 12. At this time, the top wall of the mobile dust collector 22 is closely attached to the bottom wall of the cover plate 20, and the air discharge outlet 62 is aimed at the center opening 50 of the cover plate 20. Thus, the dust inlet dust collection chamber and air discharge outlet 62 of the mobile dust collector 22, the center opening 50 of the cover plate 20, the suction hole 40 of the electrical fan 16, the inside space of the fan housing 36, the air discharge outlet 42 of the fan housing 36 and the grille type exhaust port 28 of the housing 12 constitute an air flow passage. When the electrical fan 16 is started to induce a forced flow of air, the flow of air goes through the dust inlet of the mobile dust collector 22 out of the grille type exhaust port 28 to such dust particles around the dust inlet into the inside of the dust chamber.

When wishing to detach the electrical fan 16 from the housing 12 for maintenance or replacement, remove the mobile dust collector 22 out of the housing 12 to expose the cover plate 20, and then press the flat retaining members 32 with the fingers to disengage the hooks 34 from the cover plate 20 and to keep the hooks 34 in the retaining holes 54 of the cover plate 20. At this time, the spring power of the elastic members 14 forces the electrical fan 16 to push the cover plate 20 outwards, thereby completely disengaging the cover plate 20 from the flat retaining members 32. At this time, the electrical fan 16 can be taken out of the fan chamber 26 easily without any constraints. This electrical fan dismounting procedure is quite simple without using a screwdriver or any other hand tools.

In conclusion, the technical feature of the present invention is the use of the detachable cover plate 20 to hold down the electrical fan 16 in the fan chamber 26 so that the electrical fan 16 can be installed in the fan chamber 26 conveniently without any fastening members, such as screws, or the use of any hand tool, such as screwdriver. Further, after removal of the cover plate 20, the electrical fan 16 can be removed from the housing 12 easily. In other words, subject to the technical content provided by the present invention, the mounting and dismounting of the electrical fan of the mobile robotic vacuum cleaner are easy. Further, the fastening structure between the cover plate and the housing is not limited to the matching arrangement of the flat retaining members 32 and the retaining holes 54, and any other fastening measure, for example, hook joint, can be used as a substitute.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A mobile robotic vacuum cleaner, comprising:

a housing defining a fan chamber and an exhaust port in communication with said fan chamber;

an electrical fan detachably mounted in said fan chamber of said housing, said electrical fan comprising a suction hole, and an air discharge outlet facing said exhaust port of said housing; and a cover plate detachably mounted in said housing and stopped against said electrical fan to hold said electrical fan in said fan chamber, said cover plate comprising an opening facing said suction hole.

2. The mobile robotic vacuum cleaner as claimed in claim 1, wherein said cover plate comprises two retaining holes; said housing comprises two retaining members, each said retaining member comprising a hook insertable into one said retaining hole to hook on said cover plate.

3. The mobile robotic vacuum cleaner as claimed in claim 2, wherein said two retaining members are disposed in said fan chamber.

4. The mobile robotic vacuum cleaner as claimed in claim 1, further comprising elastic means adapted for imparting a pressure to said electrical fan against said cover plate.

5. The mobile robotic vacuum cleaner as claimed in claim 4, wherein said elastic means is a compression spring set in between said housing and said electrical fan.

6. The mobile robotic vacuum cleaner as claimed in claim 5, wherein said housing comprises a locating post suspending in said fan chamber; said electrical fan comprises a locating hole; said compression spring has one end thereof sleeved onto said locating post and an opposite end thereof positioned in said locating hole.

7. The mobile robotic vacuum cleaner as claimed in claim 1, further comprising a gasket ring set in between said cover plate and said electrical fan and extending around the opening of said cover plate.

8. The mobile robotic vacuum cleaner as claimed in claim 7, further comprising an elastic means adapted for imparting a pressure to said electrical fan against said cover plate.

9. The mobile robotic vacuum cleaner as claimed in claim 8, wherein said elastic means is a compression spring set between said housing and said electrical fan.

10. The mobile robotic vacuum cleaner as claimed in claim 9, wherein said housing comprises a locating post suspending in said fan chamber; said electrical fan comprises a locating hole; said compression spring has one end thereof sleeved onto said locating post and an opposite end thereof positioned in said locating hole.

* * * * *